US006900787B2

(12) United States Patent
Nukiyama

(10) Patent No.: US 6,900,787 B2
(45) Date of Patent: May 31, 2005

(54) TIMING CONTROL CIRCUIT, AN IMAGE DISPLAY APPARATUS, AND AN EVALUATION METHOD OF THE IMAGE DISPLAY APPARATUS

(75) Inventor: Kazuhiro Nukiyama, Kawasaki (JP)

(73) Assignee: Fujitsu Display Technologies Corporation, Kawasaki (JP)

( * ) Notice: Subject to any disclaimer, the term of this patent is extended or adjusted under 35 U.S.C. 154(b) by 317 days.

(21) Appl. No.: 10/102,004

(22) Filed: Mar. 20, 2002

(65) Prior Publication Data

US 2003/0038794 A1 Feb. 27, 2003

(30) Foreign Application Priority Data

Aug. 22, 2001 (JP) ..... 2001-251720

(51) Int. Cl.[7] ..... G09G 3/36

(52) U.S. Cl. ..... 345/99; 345/87; 345/94; 345/97

(58) Field of Search ..... 345/99, 90–97, 345/58, 87, 204, 208, 209, 213, 210; 315/169.1–169.4; 340/784; 349/58; 386/94

(56) References Cited

U.S. PATENT DOCUMENTS 4,748,444 A * 5/1988 Arai ..... 345/99
5,379,050 A * 1/1995 Annis et al. ..... 345/94
5,852,425 A * 12/1998 Bird et al. ..... 345/92
6,236,167 B1 * 5/2001 Yamaguchi et al. ..... 315/169.2
6,466,282 B2 * 10/2002 Sasuga et al. ..... 349/58
6,496,169 B1 * 12/2002 Mametsuka ..... 345/87
6,526,220 B2 * 2/2003 Oguro et al. ..... 386/94
6,577,071 B2 * 6/2003 Matsumoto ..... 315/169.4
6,667,730 B1 * 12/2003 Taguchi et al. ..... 345/99
2002/0044118 A1 * 4/2002 Sekido et al. ..... 345/87

FOREIGN PATENT DOCUMENTS

JP 5-15088 2/1993

* cited by examiner

*Primary Examiner*—Vijay Shankar
*Assistant Examiner*—Prabodh M Dharia
(74) *Attorney, Agent, or Firm*—Greer, Burns & Crain, Ltd.

(57) ABSTRACT

A timing control circuit provides at least a driver control signal and a display data signal to a driver circuit of a display panel such that a predetermined image is displayed on the display panel, dispensing with an external source providing the signals, thereby an EMI measurement of a display apparatus can be performed without influences from an external source and a cable that connects the external source to the display apparatus to be examined.

4 Claims, 9 Drawing Sheets

TIMING CONTROL CIRCUIT, AN IMAGE DISPLAY APPARATUS, AND AN EVALUATION METHOD OF THE IMAGE DISPLAY APPARATUS

BACKGROUND OF THE INVENTION

1. Field of the Invention

The present invention generally relates to a timing control circuit, an image display apparatus, and an evaluation method of the image display apparatus, and especially relates to a timing control circuit, an image display apparatus and an evaluation method of the image display apparatus, evaluation of which is performed by displaying a predetermined image on a display panel.

2. Description of the Related Art

Conventionally, an EMI (Electromagnetic Interference) evaluation of an image display apparatus, such as an LCD (Liquid Crystal Display), has been performed by a system as shown in FIG. 1.

FIG. 1 shows a block diagram of an example of a system that performs EMI evaluation of an LCD. As for the system of FIG. 1, an LCD 1 and a personal computer (henceforth PC) 2 are connected through a cable 3.

Here, the PC 2 transmits a signal (for example, a clock signal, a display enable signal, and a display-data signal) to a timing controller 10 of the LCD 1 through the cable 3 such that the LCD 1 displays a predetermined image for EMI evaluation.

The timing controller 10 generates a gate driver control signal (for example, a gate clock signal, and a gate start signal) that controls a gate driver 11, using the signal received from the PC 2, and transmits the gate driver control signal to the gate driver 11. Further, the timing controller 10 generates a source driver control signal (for example, a dot clock signal, an output-control signal, a polarity signal, a display data signal, a data start signal) that controls a source driver 12, using the signal received from the PC 2, and transmits the source driver control signal to the source driver 12.

The gate driver 11 and the source driver 12 display the predetermined image for EMI evaluation on a liquid crystal panel 13 according to the gate driver control signal and the source driver control signal, respectively. Here, in the liquid crystal panel 13, pixels are provided in a matrix form, each pixel including a TFT (Thin Film Transistor) 17 that is connected to a liquid crystal capacitor 18, a data (source) bus line 15, and a gate bus line 16.

That is, the LCD 1 receives a signal required in order to display the predetermined image for EMI evaluation from the PC 2, and displays the predetermined image for EMI evaluation on the liquid crystal panel 13 according to the received signal.

As described above, the EMI evaluation of the LCD 1 is performed while the predetermined image for EMI evaluation is displayed on the liquid crystal panel 13. That is, the LCD 1 has to keep receiving a signal required in order to display the predetermined image for EMI evaluation from the PC 2 during the EMI evaluation.

Therefore, in the system of FIG. 1, a problem is that the PC 2 and the cable 3 are indispensable in addition to the LCD 1, which makes it difficult to identify which of the LCD 1, the PC 2, and the cable 3 is generating and radiating an EMI. Consequently, in the system of FIG. 1, it is difficult to measure an EMI of the LCD 1 itself.

The present invention is made in view of the above-mentioned point, and aims at offering a timing control circuit, an image display apparatus, and an evaluation method of the image display apparatus that realize evaluation of the image display apparatus by displaying a predetermined image on a display panel, eliminating influences of the PC 2 and the cable 3.

SUMMARY OF THE INVENTION

It is a general object of the present invention to provide an apparatus and a method that substantially obviate one or more of the problems caused by the limitations and disadvantages of the related art.

Features and advantages of the present invention will be set forth in the description that follows, and in part will become apparent from the description and the accompanying drawings, or may be learned by practice of the invention according to the teachings provided in the description. Objects as well as other features and advantages of the present invention will be realized and attained by a circuit, an apparatus and a method particularly pointed out in the specification in such full, clear, concise, and exact terms as to enable a person having ordinary skill in the art to practice the invention.

To achieve these and other advantages and in accordance with the purpose of the invention, as embodied and broadly described herein, the present invention provides at least a timing control circuit that generates a display data signal and a driver control signal such that a predetermined test image is generated without needing the display data and the driver control signals to be supplied from an external source. Here, the display data signal and the driver control signal can be generated using a clock signal generated in an image display apparatus. Accordingly, the present invention realizes evaluation of an image display apparatus by displaying a predetermined image on a display panel, which is not influenced by an external component, such as the PC 2 and the cable 3.

DESCRIPTION OF THE PREFERRED EMBODIMENTS

In the following, embodiments of the present invention will be described with reference to the accompanying drawings. Although descriptions below explain embodiment examples of EMI evaluation of an LCD as an example of an image display apparatus, the present invention is applicable to other image display apparatuses such as a PDP (Plasma Display Panel) display apparatus, an EL (Electro Luminescence) display apparatus and so on.

Figure 1:
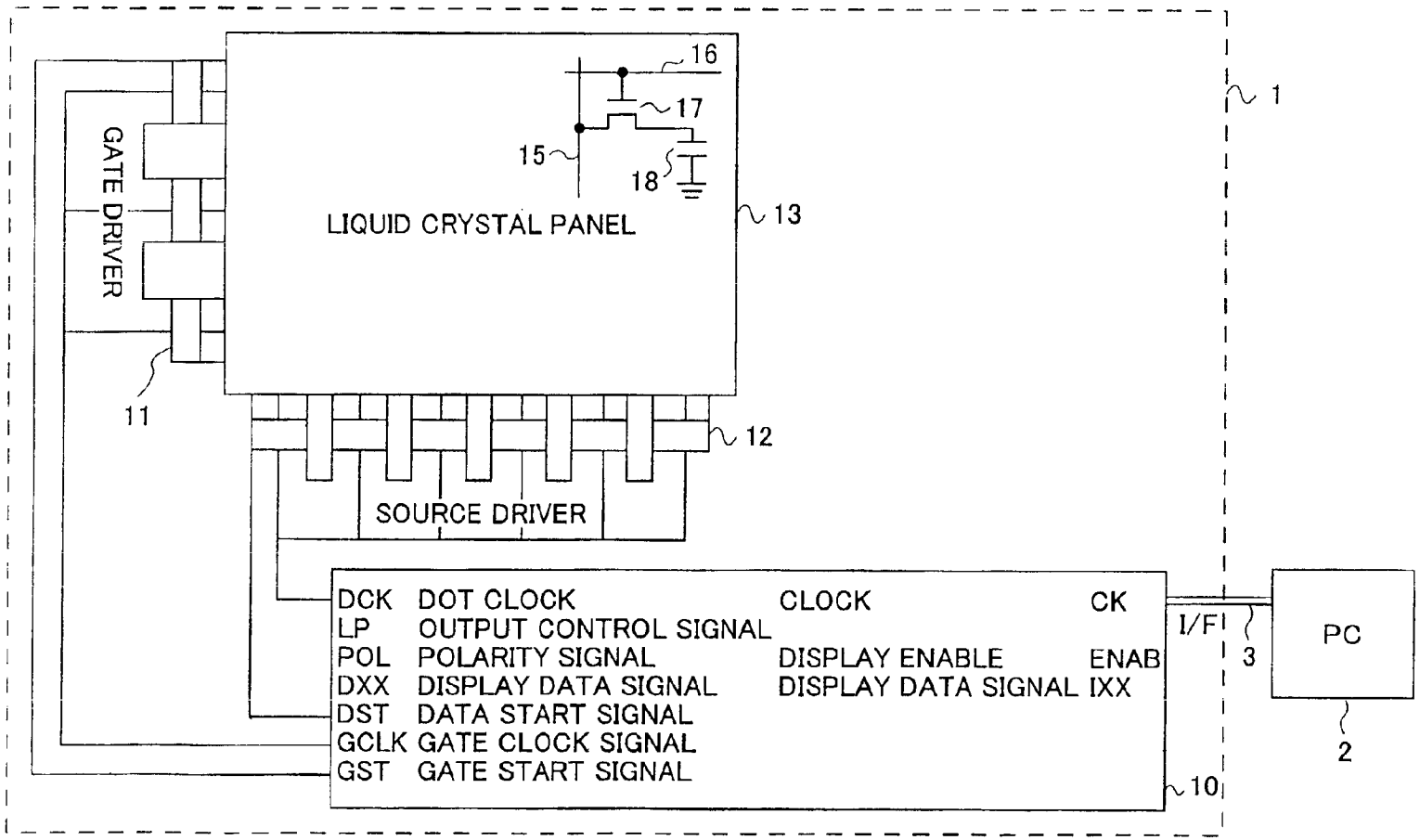
FIG. 1 is a block diagram of an example of a system that performs EMI evaluation of an LCD.
Figure 2:
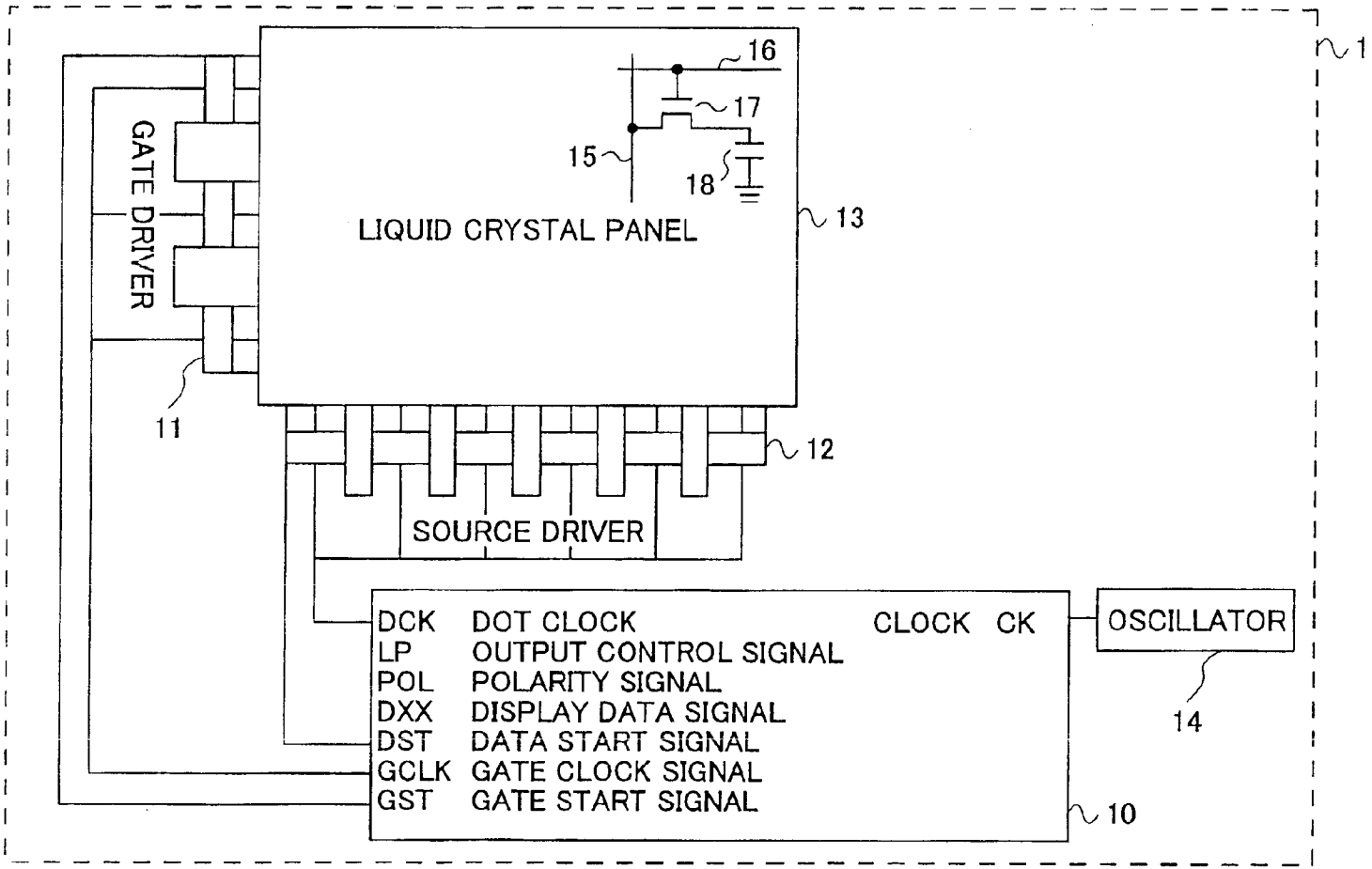
FIG. 2 is a block diagram of an LCD of an embodiment of the present invention.

FIG. 2 shows a block diagram of an LCD 1 of the embodiment of the present invention. The LCD 1 of FIG. 2 includes a timing controller 10, a gate driver 11, a source driver 12, a liquid crystal panel 13, and an oscillator 14. That is, the LCD 1 of FIG. 2 does not require a signal (for example, a display enable signal, and a display data signal) from an external source in displaying a predetermined screen for EMI evaluation.

The oscillator 14, such as a crystal oscillator, generates a clock signal CK, and supplies the generated clock signal CK to the timing controller 10. The timing controller 10 generates a gate driver control signal (for example, a gate clock signal GCLK, and a gate start signal GST) that controls the gate driver 11, using the supplied clock signal CK, and transmits the gate driver control signal to the gate driver 11.

The timing controller 10 further generates a source driver control signal (for example, a dot clock signal DCK, an output-control signal LP, a polarity signal POL, a display data signal DXX, and a data start signal DST) that controls the source driver 12, using the supplied clock signal CK, and transmits the source driver control signal to the source driver 12.

That is, the timing controller 10 of FIG. 2 generates the gate driver control signal, and the source driver control signal, using the clock signal CK. Details of process that generate the gate driver control signal and the source driver control signal using the clock signal CK are given later.

Figure 3:
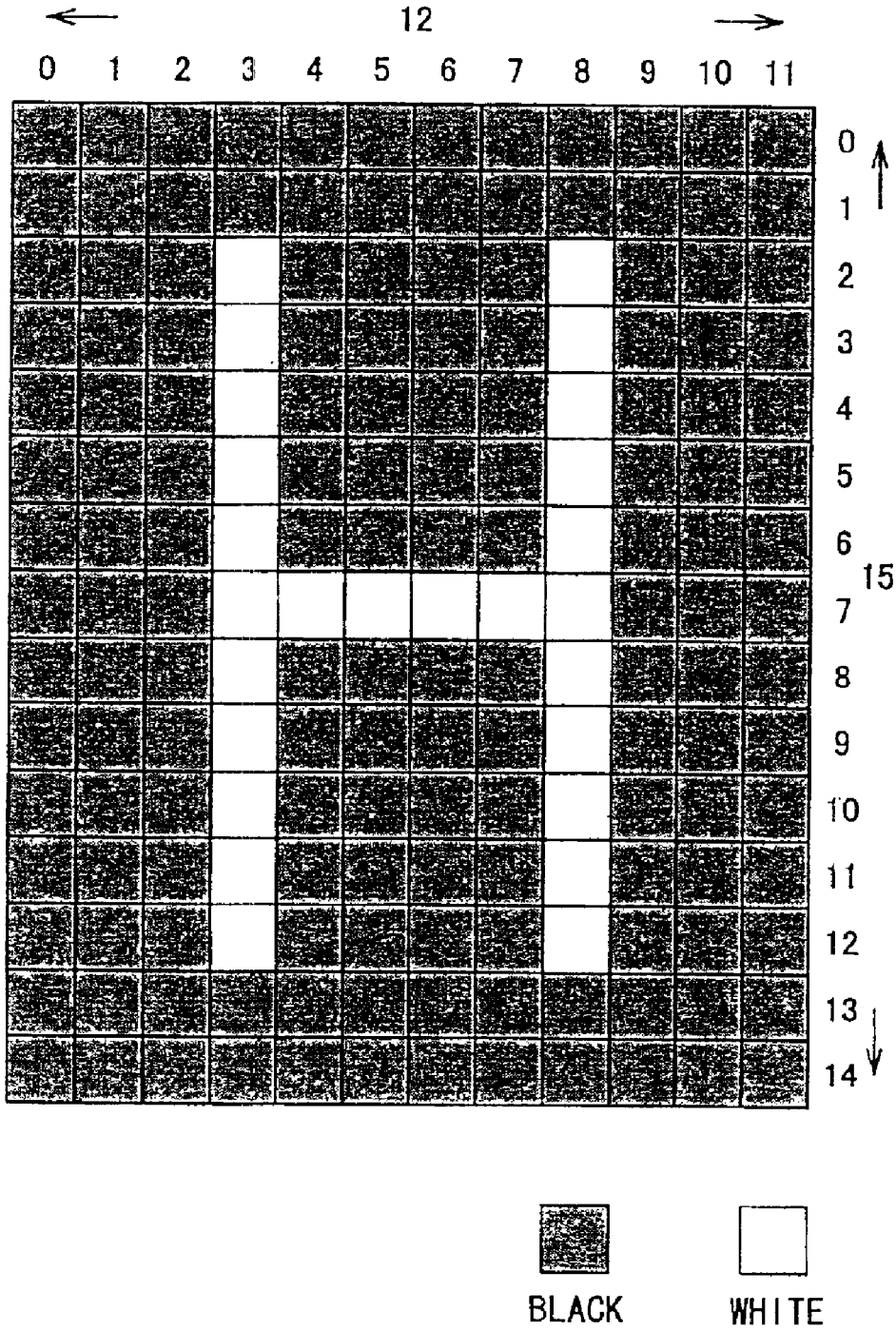
FIG. 3 is an image figure of an example of an H-pattern.

Further, the gate driver 11 and the source driver 12 display a predetermined image for EMI evaluation on the liquid crystal panel 13 according to the gate driver control signal and the source driver control signal. The predetermined image for EMI evaluation includes one or more H-patterns aligned horizontally and one or more the H-patterns aligned vertically. An example of an H-pattern is shown in FIG. 3.

The H-pattern in this example occupies a dot matrix of 15×12, and uses a black dot as a background, and a white dot to represent an H-pattern. Here, row numbers 0–14 are given to horizontal lines from top to bottom, and column numbers 0–11 are given to vertical columns from left to right.

Figure 4:
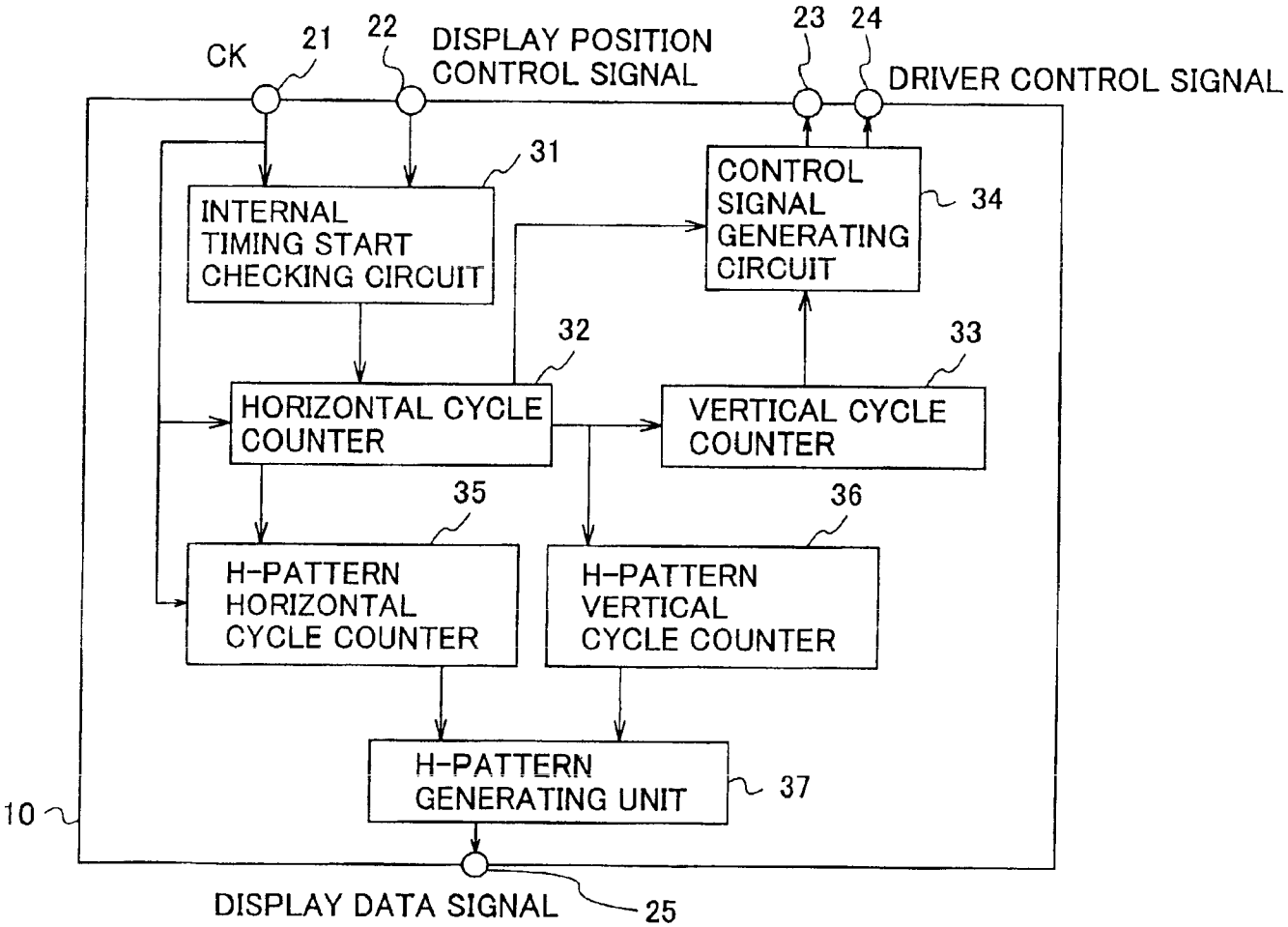
FIG. 4 is a block diagram of a timing controller of an embodiment of the present invention.

Hereafter, processing of the timing controller 10 is explained in detail. FIG. 4 shows a block diagram of the timing controller 10 of the embodiment of the present invention. The timing controller 10 of FIG. 4 includes input terminals 21 and 22, output terminals 23–25, an internal-timing start checking circuit 31, a horizontal cycle counter 32, a vertical cycle counter 33, a control signal generating circuit 34, an H-pattern horizontal cycle counter 35, an H-pattern vertical cycle counter 36, and an H-pattern generating circuit 37.

The input terminal 21 is connected to the oscillator 14. A clock signal CK is supplied to the internal-timing start checking circuit 31 from the input terminal 21. In addition, the input terminal 22 may be connected to the PC 2 through the cable 3, if necessary. When the PC 2 is connected to the input terminal 22 by the cable 3, a display enable signal ENAB as a display-position control signal is supplied to the internal-timing start checking circuit 31 from the input terminal 22.

The internal-timing start checking circuit 31 switches a timing mode between an external timing mode and an internal-timing mode, depending upon whether or not the display enable signal ENAB is supplied from the input terminal 22.

Here, the external timing mode is the mode that displays an image on the liquid crystal panel 13 according to a signal (for example, a clock signal, a display enable signal, a display data signal) received from the PC 2. Conversely, the internal-timing mode is the mode that displays an image on the liquid crystal panel 13 according to the signal (for example, the gate driver control signal, the source driver control signal) generated by the timing controller 10.

For example, the internal-timing start checking circuit 31 counts the number of clock pulses while a level of the display enable signal ENAB supplied does not change, and when the counted number reaches a predetermined value, the mode is changed from the external timing mode to the internal-timing mode. In addition, if the level of display enable signal ENAB changes while operating under the internal-timing mode, the internal-timing start checking circuit 31 switches the mode from the internal-timing mode to the external timing mode.

When the internal-timing start checking circuit 31 switches the mode from the external timing mode to the internal-timing mode, a pulse that starts the internal-timing mode is supplied to the horizontal cycle counter 32.

When the pulse that starts the internal-timing mode is received from the internal-timing start checking circuit 31, the horizontal cycle counter 32 starts counting the clock pulses CK supplied from the input terminal 21. The horizontal cycle counter 32 resets a counted number when the counted number reaches a predetermined value (for example, the number of clock pulses equivalent to one horizontal cycle), while supplying a one-clock-wide pulse to the vertical cycle counter 33, the control signal generating circuit 34, and the H-pattern vertical cycle counter 36.

Further, the horizontal cycle counter 32 supplies a display-position start signal ITMSTART that indicates a display-position start (for example, left end of a display area) to the H-pattern horizontal cycle counter 35 and the H-pattern vertical cycle counter 36.

The vertical cycle counter 33 counts the number of the one-clock-wide pulses supplied from the horizontal cycle counter 32, resets the counted number, when the counted number reaches a predetermined value (for example, the number of the pulses equivalent to one vertical cycle), and supplies a one-clock-wide pulse to the control signal generating circuit 34. The timing controller 10 generates a horizontal cycle and a vertical cycle by the horizontal cycle counter 32 and the vertical cycle counter 33, respectively.

The control signal generating circuit 34 generates the gate driver control signal and the source driver control signal, using the one-clock-wide pulse supplied from the horizontal cycle counter 32, and the one-clock-wide pulse supplied from the vertical cycle counter 33, respectively. Further, the control signal generating circuit 34 outputs the source driver control signal from the output terminal 24, while outputting the gate driver control signal from the output terminal 23.

The H-pattern horizontal cycle counter 35 starts counting the number of the clock pulses CK supplied from the input terminal 21, when the display-position start signal ITMSTART is supplied from the horizontal cycle counter 32.

The H-pattern horizontal cycle counter 35 counts the number of clock pulses that corresponds to the horizontal cycle of the H-pattern (for example, 0–11 of the H-pattern of FIG. 3), and supplies the counted number to the H-pattern generating circuit 37. In addition, the H-pattern horizontal cycle counter 35 resets the counted number, when the number of clocks equivalent to the horizontal cycle of the H-pattern is reached.

The H-pattern vertical cycle counter 36 counts the number of the one-clock-wide pulses supplied from the horizontal cycle counter 32. The H-pattern vertical cycle counter 36 counts the number of the pulses that corresponds to the vertical cycle of the H-pattern (for example, 0–14 of the H-pattern of FIG. 3), and supplies the counted number to the H-pattern generating circuit 37. In addition, the H-pattern vertical cycle counter 36 resets the counted number when the number of the pulses equivalent to the vertical cycle of the H-pattern is reached.

The H-pattern generating circuit 37 generates the display data according to the H-pattern using the counted number supplied from the H-pattern horizontal cycle counter 35, and the counted number supplied from the H-pattern vertical cycle counter 36. The H-pattern generating circuit 37 outputs the generated display data from the output terminal 25.

In the case of the H-pattern of FIG. 3, for example, the H-pattern horizontal cycle counter 35 supplies the numbers of counts 0–11, and the H-pattern vertical cycle counter 36 supplies the numbers of counts 0–14, each to the H-pattern generating circuit 37.

Here, the H-pattern of FIG. 3 is configured by black lines (line numbers 0, 1, 13, and 14) which consist of only black cells, black-and-white mixed lines (line numbers 2–6, 8–12) for vertical strokes of the character "H", and a line (line number 7) for a horizontal stroke of the "H".

The black lines are displayed by the H-pattern generating circuit 37 generating a display data signal of 12 consecutive black dots, and outputting from the output terminal 25. In the case of the black-and-white mixed lines, the H-pattern generating circuit 37 generates "black, black, black, white, black, black, black, black, white, black, black and black" dots in this sequence and outputs from the output terminal 25. In the case of displaying the horizontal stroke, the H-pattern generating circuit 37 generates three black dots, six white dots and three black dots in this order, and outputs from the output terminal 25.

Selection of a black line, a black-and-white mixed line, and a line for the horizontal stroke can be performed by matching a counted number 0–14 supplied from the H-pattern vertical cycle counter 36, and the line numbers 0–14. Thus, it is possible to generate a display data signal representing the H-pattern by using a counter that is reset according to the horizontal and vertical cycle of the H-pattern.

Figure 5:
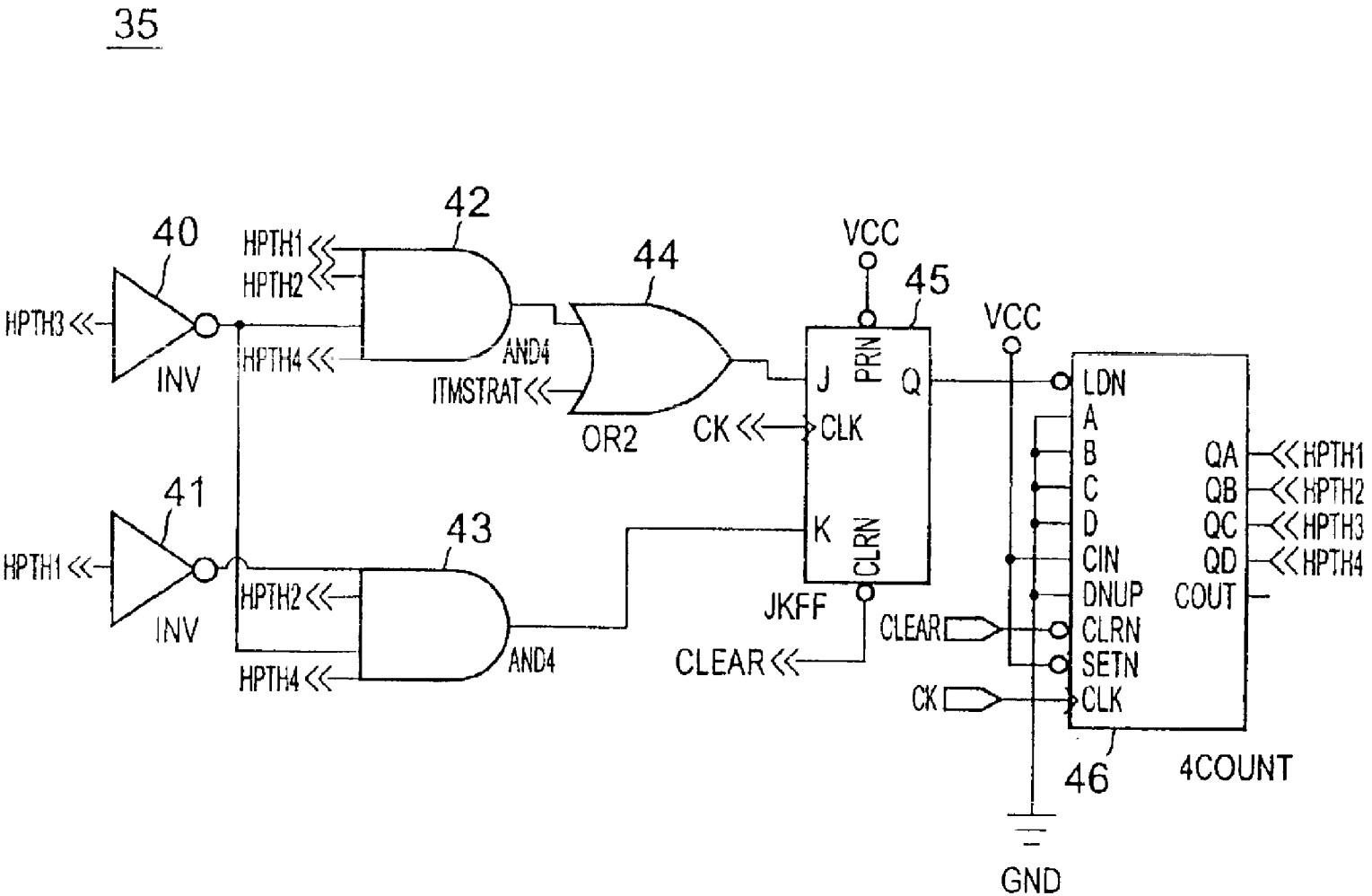
FIG. 5 is a block diagram of an H-pattern horizontal cycle counter of an embodiment of the present invention.

FIG. 5 shows a block diagram of the H-pattern horizontal cycle counter 35 of the embodiment of the present invention. The H-pattern horizontal cycle counter 35 of FIG. 5 includes NOT circuits 40 and 41, AND circuits 42 and 43, an OR circuit 44, a JK-flip-flop circuit (henceforth a JK-FF circuit) 45, and a counter circuit 46.

Figure 6:
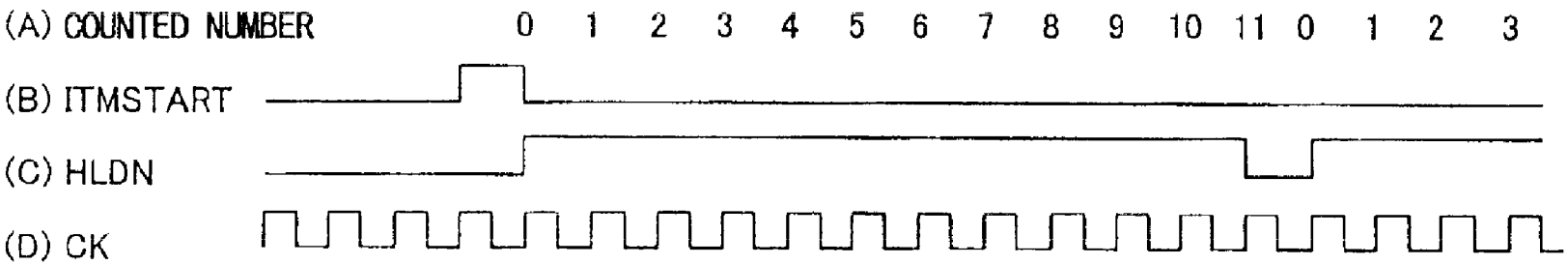
FIG. 6 is a timing chart of an example of an H-pattern horizontal cycle counter.

Hereafter, processing of the H-pattern horizontal cycle counter 35 is explained, referring to a timing chart of FIG. 6 that shows operational timing of an example of the H-pattern horizontal cycle counter 35.

The display-position start signal ITMSTART such as shown by (B) in FIG. 6 is supplied from the horizontal cycle counter 32 to the OR circuit 44. In the present embodiment, the display-position start signal ITMSTART is active when at a high level, and expresses the display-position start. If the display-position start signal ITMSTART becomes high, the OR circuit 44 will supply the high-level signal to the terminal J of the JK-FF circuit 45.

When the high-level signal is supplied to terminal J, the JK-FF circuit 45 supplies the high-level signal HLDN as shown by (c) of FIG. 6 to a terminal LDN of the counter circuit 46. When the high-level signal HLDN is supplied to the terminal LDN, the counter circuit 46 starts counting the clock signal CK as shown by (D) of FIG. 6, which is supplied from the input terminal 21.

The counter circuit 46 outputs a counted number of clock pulses of the clock signal CK as shown by (A) of FIG. 6(A) in a binary number from terminals QA–QD. For example, when the counted number is 11, the outputs are 1 from terminal QA, 1 from terminal QB, 0 from terminal QC and 1 from terminal QD. The counter circuit 46 supplies the output counted number to the H-pattern generating circuit 37.

The AND circuit 43 supplies a high-level signal to a terminal K of the JK-FF circuit 45, when the counted number output from the counter circuit 46 is 10.The JK-FF circuit 45 changes the level of the signal HLDN to low as shown by (C) of FIG. 6, which is supplied to the terminal LDN of the counter circuit 46, when the high-level signal is supplied to the terminal K. The counter circuit 46 resets the counted number of the clock signal CK, when the signal HLDN indicating the low level is supplied to terminal LDN.

The AND circuit 42 supplies a high-level signal to the terminal J of the JK-FF circuit 45 through the OR circuit 44, when the counted number output from the counter circuit 46 is 11. The JK-FF circuit 45 supplies the signal HLDN in the high level to the terminal LDN of the counter circuit 46, when the high-level signal is supplied to the terminal J. The counter circuit 46 starts counting the number of clock pulses of the clock signal CK, when the high-level signal HLDN is supplied to terminal LDN.

Therefore, the H-pattern horizontal cycle counter 35 counts the number of clocks equivalent to the horizontal cycle of the H-pattern (for example, 0–11 in FIG. 5), and supplies the counted number to the H-pattern generating circuit 37.

Figure 7:
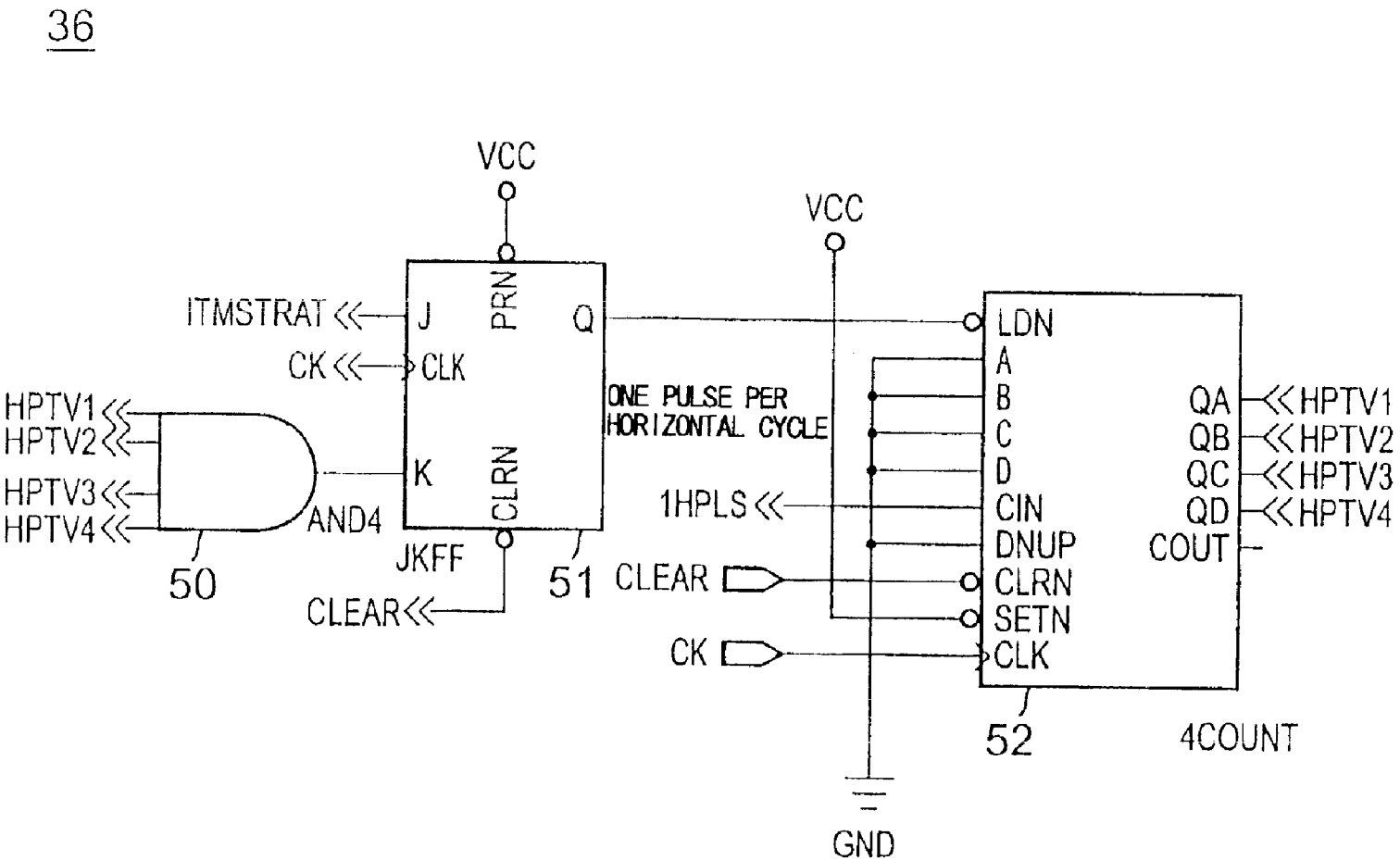
FIG. 7 is a block diagram of an H-pattern vertical cycle counter of an embodiment of the present invention.

FIG. 7 shows a block diagram of an H-pattern vertical cycle counter 36 of the embodiment of the present invention. The H-pattern vertical cycle counter 36 of FIG. 7 includes an AND circuit 50, a JK-FF circuit 51, and a counter circuit 52.

Figure 8:
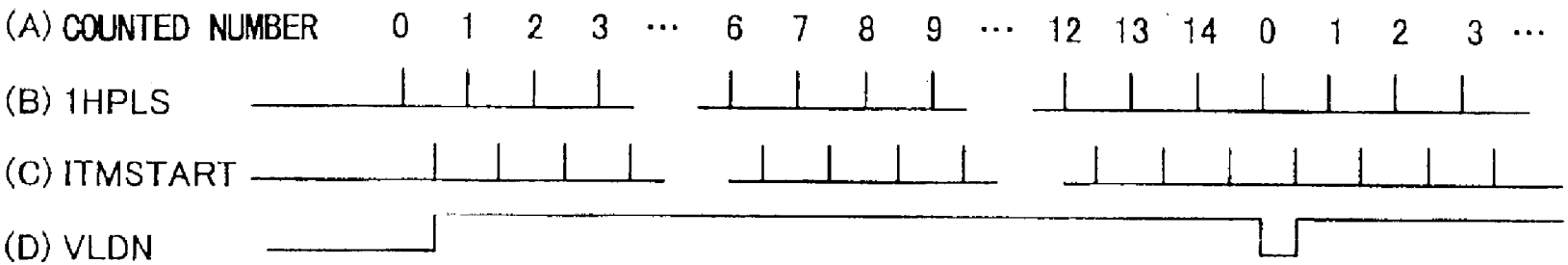
FIG. 8 is a timing chart of an example of the H-pattern vertical cycle counter.

Processing of the H-pattern vertical cycle counter 36 is explained, referring to the timing chart of FIG. 8 that shows operational timing of an example of the H-pattern vertical cycle counter 36.

The display-position start signal ITMSTART, as shown by (C) of FIG. 8, is supplied from the horizontal cycle counter 32 to a terminal J of the JK-FF circuit 51. When a high-level signal is supplied to the J terminal, the JK-FF circuit 51 supplies a high-level signal VLDN, as shown by (D) of FIG. 8, to a terminal LDN of the counter circuit 52. When the high-level signal VLDN is supplied to the terminal LDN, the counter circuit 52 starts counting the number of 1HPLS pulses, shown by (B) of FIG. 8, supplied from the horizontal cycle counter 32 for every 1 horizontal cycle.

The counter circuit 52 counts the number of the 1HPLS pulses, as shown by (A) of FIG. 8(A), and outputs the number in a binary number from terminals QA, QB, QC and QD. For example, when the counted number is 7, 1 is output from the terminal QA, 1 is output from the terminal QB, 1 is output from the terminal QC, and 0 is output from the terminal QD. The counter circuit 52 supplies the output counted number to the H-pattern generating circuit 37.

When the counted number output from the counter circuit 52 is 15, the AND circuit 50 supplies a high-level signal to the terminal K of the JK-FF circuit 51. The JK-FF circuit 51 supplies the signal VLDN in a low level as shown by (D) of FIG. 8 to the terminal LDN of the counter circuit 52, if a high-level signal is supplied to the terminal K. The counter circuit 52 will reset the counted number of the 1HPLS pulses, when the signal VLDN of a low level is supplied to the terminal LDN.

Accordingly, the H-pattern vertical cycle counter 36 counts the number equivalent to the vertical cycle of the H-pattern (for example, 0–15 in FIG. 5), and supplies the counted number to the H-pattern generating circuit 37.

Figure 9:
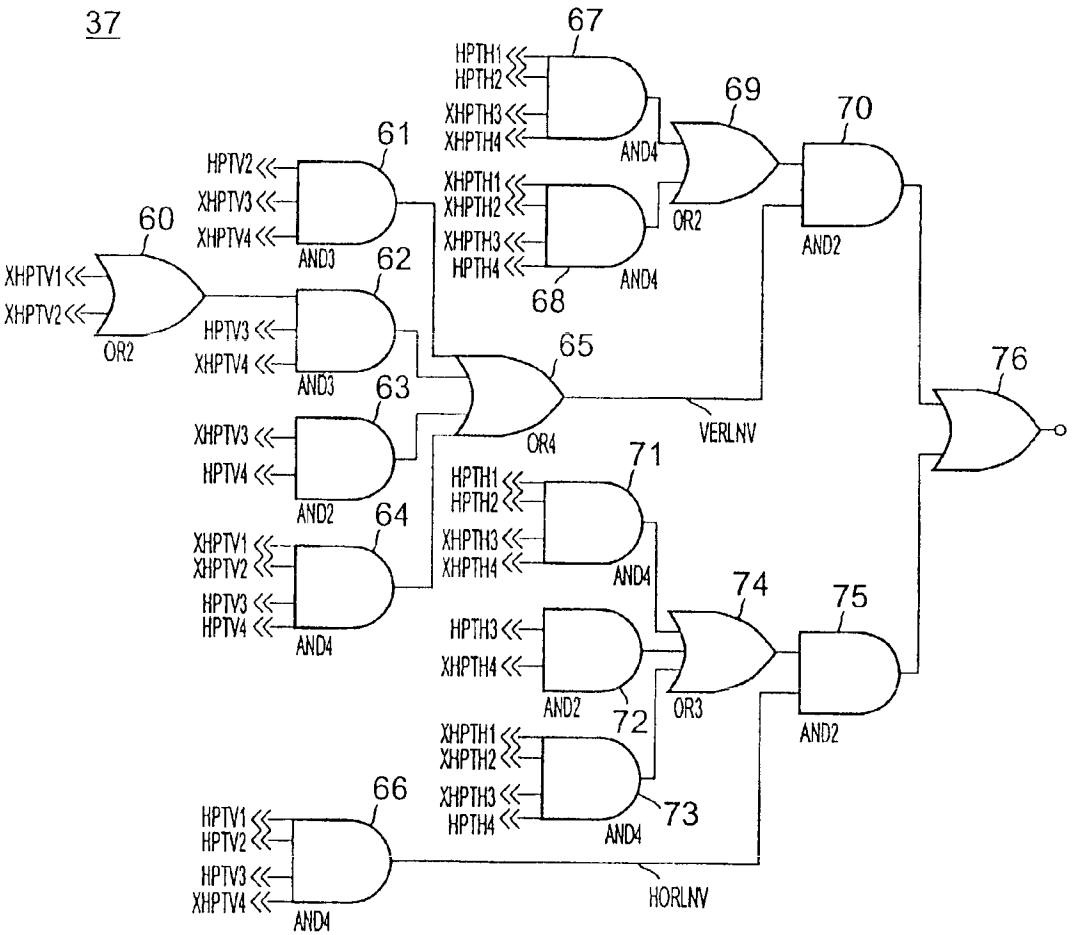
FIG. 9 is a block diagram of an H-pattern generating circuit of an embodiment of the present invention.

FIG. 9 shows a block diagram of an H-pattern generating circuit 37 of the embodiment of the present invention. The H-pattern generating circuit 37 of FIG. 9 includes OR circuits 60, 65, 69, 74, and 76, and AND circuits 61–64, 66–68, 70–73 and 75.

Incoming signals HPTH 1–4 of FIG. 9 are the same as HPTH 1–4 signals output from the counter circuit 46 of FIG. 5, respectively. Incoming signals HPTV 1–4 are the same as signals HPTV 1–4 output from the counter circuit 52 of FIG. 7, respectively. Incoming signals XHPTV 1–4 and XHPTH 1–4 are reverse signals of the incoming signals HPTV 1–4 and HPTH 1–4, respectively. Here, inverter circuits that generate the reverse signals are omitted.

The AND circuit 61 outputs a high-level signal to the OR circuit 65, when the counted number output from the counter circuit 52 is one of 2 and 3. The AND circuit 62 outputs a high-level signal to the OR circuit 65, when the counted number output from the counter circuit 52 is one of 4, 5 and 6. The AND circuit 63 outputs a high-level signal to the OR circuit 65, when the counted number output from the counter circuit 52 is one of 8 through 11. The AND circuit 64 outputs a high-level signal to the OR circuit 65, when the counted number output from the counter circuit 52 is 12.

Accordingly, the OR circuit 65 outputs the signal VERLNV which becomes high-level to the AND circuit 70, when the counted number output from the counter circuit 52 is one of 2 through 6, and 8 through 12. In other words, the signal VERLNV becomes high when the black-and-white mixed lines are processed.

On the other hand, the AND circuit 66 outputs to the AND circuit 75 a signal HORLNV that becomes high, when the counted number output from the counter circuit 52 is 7. In other words, the signal HORLNV becomes high when processing the line that includes the horizontal stroke of the character "H".

The AND circuit 67 outputs a high-level signal to the OR circuit 69, when the counted number output from the counter 46 is 3. The AND circuit 68 outputs a high-level signal to the OR circuit 69, when the counted number output from the counter 46 is 8. Consequently, the OR circuit 69 outputs to the AND circuit 70 a signal that becomes high, when the counted number outputted from the counter circuit 46 is one of 3 and 8.

Accordingly, the AND circuit 70 outputs a signal that becomes high to the OR circuit 76, when the counted number output from the counter circuit 52 is one of 2 through 6, and 8 through 12, and when the counted number output from the counter circuit 46 is one of 3 and 8. In other words, the AND circuit 70 outputs to the OR circuit 76 a signal that becomes high when one of the line numbers 2 through 6 and 8 through 12 and one of the column numbers 3 and 8 of the H-pattern of FIG. 3 are processed.

On the other hand, the AND circuit 71 outputs a high-level signal to the OR circuit 74, when the counted number output from the counter 46 is 3. The AND circuit 72 outputs a high-level signal to the OR circuit 74, when the counted number output from the counter circuit 46 is one of 4 through 7. Further, the AND circuit 73 outputs a high-level signal to the OR circuit 74, when the counted number output from the counter circuit 46 is 8. Consequently, the OR circuit 74 outputs to the AND circuit 75 a signal that becomes high, when the counted number outputted from the counter circuit 46 is one of 3 through 8.

Accordingly, the AND circuit 75 outputs to the OR circuit 76 a signal that becomes high, when the counted numbers output from the counter circuit 52 is 7, and when the counted number output from the counter circuit 46 is one of 3 through 8. In other words, the AND circuit 75 outputs to OR circuit 76 a signal that becomes high when the line number 7, and one of the column numbers 3 through 8 of the H-pattern of FIG. 3 are processed.

As mentioned above, the OR circuit 76 can output display data corresponding to the H-pattern as shown in FIG. 3. Although this embodiment is explained around an example of outputting display data of the H-pattern, it is possible to output display data corresponding to various patterns by changing the combination of the logical circuits of the H-pattern horizontal cycle counter 35, the H-pattern vertical cycle counter 36, and the H-pattern generating circuit 37.

In the manner described above, a predetermined test image can be displayed without having to receive display data from an outside source via a cable, both of which are sources of disturbance when ascertaining an EMI level of a display apparatus to be examined.

Further, the present invention is not limited to these embodiments, but various variations and modifications may be made without departing from the scope of the present invention.

The present application is based on Japanese priority application No. 2001-251720 filed on Aug. 22, 2001 with the Japanese Patent Office, the entire contents of which are hereby incorporated by reference.

What is claimed is:

1. A timing control circuit that provides at least a driver control signal and a display data signal to a driver circuit of a display panel such that an image corresponding to the driver control signal and the display data signal is displayed on the display panel, comprising:

a display data signal generating unit that generates a display data signal corresponding to a predetermined image for EMI evaluation;

a driver control signal generating unit that generates the driver control signal;

an internal timing start checking unit that checks whether a display position control signal is provided from an external source; and a counter that counts a horizontal cycle and a vertical cycle, according to a checking result of the internal timing start checking unit;

whereby the display data signal generating unit generates the display data signal according to the horizontal cycle and the vertical cycle counted by the counter.

2. The timing control circuit as claimed in claim 1, wherein the driver control signal generating unit generates the driver control signal according to the horizontal cycle and the vertical cycle counted by the counter.

3. An image display apparatus in which a timing control circuit provides at least a driver control signal and a display data signal to a driver circuit of a display panel such that an image is displayed on the display panel according to the driver control signal and the display data signal, wherein the timing control circuit comprises:

a display data signal generating unit which generates a display data signal corresponding to a predetermined image for EMI evaluation a driver control signal generating unit that generates a driver control signal;

an internal timing start checking unit that checks whether a display position control signal is provided from an external source; and a counter that counts a horizontal cycle and a vertical cycle, according to a checking result of the internal timing start checking unit;

whereby the display data signal generating unit generates the display data signal according to the horizontal cycle and the vertical cycle counted by the counter.

4. An EMI evaluation method of an image display apparatus in which a timing control circuit provides at least a driver control signal and a display data signal to a driver circuit of a display panel such that an image is displayed on the display panel according to the driver control signal and the display data signal, comprising:

a driver control signal and display data signal generating step, wherein the driver control signal and the display data signal are generated by the timing control circuit;

a checking step, wherein whether a display position control signal is provided from an external source is checked by an internal timing start checking unit;

a counting step, wherein a horizontal cycle and a vertical cycle are counted by a counter, according to a checking result of the internal timing start checking unit; and a display step, wherein the generated driver control signal and the display data signal are supplied from the timing control circuit to a driving circuit of the display panel such that a predetermined image corresponding to the driver control signal and the display data signal is displayed on the display panel;

wherein the driver control signal and the display data signal are generated corresponding to the counted horizontal and vertical cycles, as applied to a liquid crystal display apparatus.

* * * * *